US009856869B2

(12) United States Patent
Kruzel et al.

(10) Patent No.: US 9,856,869 B2
(45) Date of Patent: Jan. 2, 2018

(54) MOTOR, CONTROLLER AND ASSOCIATED METHOD

(71) Applicant: Regal Beloit America, Inc., Beloit, WI (US)

(72) Inventors: Steven Michael Kruzel, Dayton, OH (US); Marc Christopher McKinzie, West Wilton, OH (US); Mitchell T. Kiser, Piqua, OH (US)

(73) Assignee: Regal Beloit America, Inc., Beloit, WI (US)

( * ) Notice: Subject to any disclaimer, the term of this patent is extended or adjusted under 35 U.S.C. 154(b) by 113 days.

(21) Appl. No.: 14/685,876

(22) Filed: Apr. 14, 2015

(65) Prior Publication Data

US 2016/0305416 A1 Oct. 20, 2016

(51) Int. Cl.
*F04B 49/06* (2006.01)
*F04B 17/03* (2006.01)

(52) U.S. Cl.
CPC ..... *F04B 49/06* (2013.01); *F04B 17/03* (2013.01); *F04B 2203/0209* (2013.01); *F04B 2207/02* (2013.01); *F04B 2207/03* (2013.01); *F04B 2207/043* (2013.01)

(58) Field of Classification Search
CPC ..... F04B 49/06; F04B 17/03
USPC ..... 700/282
See application file for complete search history.

(56) References Cited

U.S. PATENT DOCUMENTS 4,545,906 A * 10/1985 Frederick ..... E04H 4/1245 210/138
7,988,425 B1 8/2011 Stingl et al.
8,480,373 B2 7/2013 Stiles et al.
8,747,075 B1 * 6/2014 Gandini ..... A01K 63/047 119/247
9,605,680 B2 * 3/2017 Stiles, Jr. ..... F04D 15/0066
2004/0013531 A1 * 1/2004 Curry ..... F04D 27/0261 417/42
2005/0123408 A1 6/2005 Koehl
2005/0226731 A1 10/2005 Mehlhorn et al.
2007/0154319 A1 7/2007 Stiles et al.
2007/0154320 A1 7/2007 Stiles et al.
2007/0154322 A1 7/2007 Stiles et al.
2007/0154323 A1 7/2007 Stiles et al.
2008/0168599 A1 * 7/2008 Caudill ..... A61H 33/005 4/541.1
2009/0090665 A1 * 4/2009 Nibler ..... E04H 4/1209 210/167.11
2009/0151801 A1 6/2009 Gorman et al.
2009/0200245 A1 * 8/2009 Steinbrueck ..... C02F 1/008 210/741

(Continued)

*Primary Examiner* — Mohammad Ali
*Assistant Examiner* — Joshua Sanders
(74) *Attorney, Agent, or Firm* — John Wagley

(57) ABSTRACT

A pump motor controller for determining the speeds and run times of a pump motor for use in a pool is provided. The controller is adapted to receive data in the form of at least one of water parameters and outdoor parameters. The controller is further adapted to receive to receive data in the form of desired pool or spa set points. The controller is further adapted to determine the speeds and run times of a pump motor for use in a pool based at least in part on data in the form of at least one of water parameters and outdoor parameters and data in the form of desired pool set points.

20 Claims, 6 Drawing Sheets

| | | Example #1 | Example #2 | Example #3 | Importance | Default |
|---|---|---|---|---|---|---|
| Inputs | Pool size | 15000 | 10000 | 30000 | 1 | |
| | Month of year | 6 | 9 | 12 | 2 | |
| | Raining? (1=Y,2=N) | 2 | 1 | 2 | 3 | |
| | Chlorine level (ppm) | 1 | 2 | 5 | | |
| | PH | 7.2 | 7.4 | 7.8 | 4 | |
| | Alkalinity | 1.5 | 1.5 | 1 | 5 | |
| | Optimization method | | | | 6 | |
| | cleanest | X | | | | |
| | lowest cost | | X | | | |
| | quietest | | | X | | |
| | | | | | | |
| Outputs | Speed 1 [RPM] | 3410 | 850 | 600 | | 3100 |
| | Duration 1 [Hours] | 3.60 | 0.82 | 2.60 | | 2 |
| | Speed 2 [RPM] | 2600 | 2300 | 1850 | | 2600 |
| | Duration 2 [Hours] | 7.20 | 1.64 | 5.20 | | 4 |
| | Speed 3 [RPM] | 1725 | | | | 1725 |
| | Duration 3 [Hours] | 14.40 | | | | 8 |

(56) References Cited

U.S. PATENT DOCUMENTS

2009/0204263 A1* 8/2009 Love ..... G05D 23/19 700/282
2010/0247332 A1 9/2010 Stiles et al.
2010/0254825 A1 10/2010 Stiles et al.
2011/0076156 A1 3/2011 Stiles et al.
2011/0091329 A1 4/2011 Stiles et al.
2012/0048813 A1* 3/2012 Irvin, Sr. ..... B01D 21/262 210/787
2012/0053737 A1* 3/2012 Valluri ..... H02J 3/14 700/276
2012/0063921 A1* 3/2012 Stiles, Jr. ..... F04D 15/0066 417/42
2012/0107140 A1 5/2012 Stiles et al.
2012/0308402 A1 12/2012 Le et al.
2013/0106321 A1 5/2013 Drye et al.
2013/0129536 A1* 5/2013 Robol ..... F04B 19/00 417/410.1
2013/0201316 A1* 8/2013 Binder ..... H04L 67/12 348/77
2013/0251542 A1 9/2013 Stiles et al.
2014/0027359 A1 1/2014 Stiles et al.
2014/0064985 A1 3/2014 Stiles et al.
2014/0303782 A1* 10/2014 Pruchniewski ..... H04L 47/70 700/275
2014/0314582 A1 10/2014 Stiles et al.
2014/0334943 A1 11/2014 Koehl et al.
2014/0334944 A1 11/2014 Koehl et al.
2014/0363308 A1 12/2014 Stiles et al.
2015/0030463 A1 1/2015 Stiles et al.
2016/0002942 A1* 1/2016 Orlando ..... F04B 49/065 700/282
2016/0174531 A1* 6/2016 Boothe ..... A01K 63/047 119/260

* cited by examiner

| | | Example #1 | Example #2 | Example #3 | Importance | Default |
|---|---|---|---|---|---|---|
| Inputs | Pool size | 15000 | 10000 | 30000 | 1 | |
| | Month of year | 6 | 9 | 12 | 2 | |
| | Raining? (1=Y,2=N) | 2 | 1 | 2 | 3 | |
| | Chlorine level (ppm) | 1 | 2 | 5 | | |
| | PH | 7.2 | 7.4 | 7.8 | 4 | |
| | Alkalinity | 1.5 | 1.5 | 1 | 5 | |
| | Optimization method | | | | 6 | |
| | cleanest | X | | | | |
| | lowest cost | | X | | | |
| | quietest | | | X | | |
| | | | | | | |
| Outputs | Speed 1 [RPM] | 3410 | 850 | 600 | | 3100 |
| | Duration 1 [Hours] | 3.60 | 0.82 | 2.60 | | 2 |
| | Speed 2 [RPM] | 2600 | 2300 | 1850 | | 2600 |
| | Duration 2 [Hours] | 7.20 | 1.64 | 5.20 | | 4 |
| | Speed 3 [RPM] | 1725 | | | | 1725 |
| | Duration 3 [Hours] | 14.40 | | | | 8 |

FIG. 5

MOTOR, CONTROLLER AND ASSOCIATED METHOD

CROSS-REFERENCE TO RELATED APPLICATIONS

Cross reference is made to the following application: 14-FW-006-UPA1 titled "CONTROLLER, MOTOR ASSEMBLY AND ASSOCIATED METHOD" filed concurrently herewith which is incorporated herein by reference.

BACKGROUND OF THE INVENTION

The embodiments described herein relate generally to fluid moving devices and controller, and more specifically, to a pump motor controller.

Pool and spa pumps are used to circulate water within the pool or spa. The circulation of the water disperses chemicals added to the water to provide for acceptable water conditions. The circulation also permits the passage of water through a filter to remove impurities from the water. Typically the pump operates for a portion of the week, typically on a schedule. The pump is typically powered by an electrical motor. The motor may be manually operated, wherein the operator manually controls the pump weekly cycle by manually turning the pump motor off and on.

More sophisticated pool pump systems have timers for turning the pump off and on based on a schedule. Some even more sophisticated pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

These pool pump systems may not provide for optimum pool conditions either at set up or over time when pool conditions change. These systems require periodic adjustments to the scheduled on off times and to the motor speeds to obtain optimum efficiency. Such systems may not provide for optimum pool conditions at initial set up and may not provide for optimum pool conditions when adjustments are made to respond to changing pool conditions. Typically such pool pump motor scheduling is made with a trial and error approach.

The present invention is directed to alleviate at least some of these problems with the prior art.

BRIEF DESCRIPTION OF THE INVENTION

According to an embodiment of the invention, a pump motor controller for determining the speeds and run times of a pump motor for use in a pool is provided. The controller is adapted to receive data in the form of at least one of water parameters and outdoor parameters. The controller is further adapted to receive to receive data in the form of desired pool or spa set points. The controller is further adapted to determine the speeds and run times of a pump motor for use in a pool based at least in part on data in the form of at least one of water parameters and outdoor parameters and data in the form of desired pool set points.

According to an aspect of the present invention, the controller may be adapted to communicate with other pool devices to turn them off and on based at least in part on data in the form of at least one of water parameters and outdoor parameters and data in the form of desired pool or spa set points.

According to another aspect of the present invention, the controller may be adapted to turn off and on integrated relay for auxiliary loads for other pool or spa devices to turn them off and on based at least in part on data in the form of at least one of water parameters and outdoor parameters and data in the form of desired pool or spa set points.

According to yet another aspect of the present invention, the controller may be adapted to adjust motor speed to achieve maximum efficiency while reaching and maintaining desired pool or spa set points.

According to yet another aspect of the present invention, the controller may be adapted to receive data in the form of time of day utility rates and peak usage utility rates. The controller may further be adapted to receive data in the form of current time of day. The controller may further be to adapted to determine the speeds and run times of a pump motor for use in a pool or spa based at least in part on data in the form of at least one of current time and utility rates.

According to yet another aspect of the present invention, the controller may be adapted such that data in the form of at least one of water parameters and outdoor parameters includes at least one of current weather conditions, upcoming weather events, season, time of day and geographical location.

According to yet another aspect of the present invention, the controller may be adapted such that data in the form of at least one of water parameters and outdoor parameters includes at least one of total alkalinity, PH, Calcium content, water hardness, free chlorine, bromine, total chlorine, turbidity, water temperature, cyanuric acid, phosphates, and total dissolved solids.

According to yet another aspect of the present invention, the controller may be adapted such that data in the form of desired water parameters and outdoor parameters includes at least two of current weather conditions, upcoming weather events, season, time of day, geographical location, total alkalinity, PH, Calcium content, water hardness, free chlorine, bromine, total chlorine, turbidity, water temperature, cyanuric acid, phosphates, and total dissolved solids.

According to yet another aspect of the present invention, the controller may be adapted such that data in the form of desired pool or spa set points includes at least one of turns, motor speed, number of pool users and pool size.

According to another embodiment of the invention, an electric motor assembly for use to power a pump in a pool is provided. The motor assembly includes a motor adapted to be connected to the pump and a pump motor controller for controlling the motor. The controller is adapted to receive data in the form of water parameters and outdoor parameters. The controller is further adapted to receive data in the form of desired pool or spa set points. The controller is further adapted to determine the speeds and run times of a pump motor for use in a pool based at least in part on data in the form of at least one of water parameters and outdoor parameters and data in the form of desired pool set points.

According to an aspect of the present invention, the controller may be adapted to communicate with other pool devices to turn them off and on based at least in part on data in the form of at least one of water parameters and outdoor parameters and data in the form of desired pool or spa set points.

According to another aspect of the present invention, the controller may be adapted to turn off and on integrated relay for auxiliary loads for other pool or spa devices to turn them off and on based at least in part on one of data in the form of water parameters and outdoor parameters and data in the form of desired pool or spa set points.

According to yet another aspect of the present invention, the controller may be adapted to adjust motor speed to achieve maximum efficiency while reaching and maintaining desired pool or spa set points.

According to yet another aspect of the present invention, the controller may be adapted to receive data in the form of time of day utility rates and peak usage utility rates, to receive data in the form of current time of day, and to determine the speeds and run times of a pump motor for use in a pool or spa based at least in part on data in the form of at least one of current time and utility rates based on usage level.

According to yet another aspect of the present invention, the controller may be adapted such that data in the form of water parameters and outdoor parameters includes at least one of current weather conditions, upcoming weather events, season, time of day and geographical location.

According to yet another aspect of the present invention, the controller may be adapted such that data in the form of water parameters and outdoor parameters includes at least one of total alkalinity, PH, Calcium content, water hardness, free chlorine, bromine, total chlorine, turbidity, water temperature, cyanuric acid, phosphates, and total dissolved solids.

According to another embodiment of the invention, a method for determining the speeds and run times of a pump motor for use in a pool is provided. The method includes the steps of providing a pump motor, receiving data in the form of water parameters and outdoor parameters, receiving data in the form of desired pool or spa set points, and determining the speeds and run times of a pump motor for use in a pool based at least in part on data in the form of at least one of water parameters and outdoor parameters and data in the form of desired pool set points.

According to an aspect of the present invention, the method may further include the step of communicating with other pool devices to turn them off and on based at least in part on data in the form of at least one of water parameters and outdoor parameters and data in the form of desired pool or spa set points.

According to another aspect of the present invention, the method may further include the step of turning off and on integrated relay for auxiliary loads for other pool or spa devices to turn them off and on based at least in part on data in the form of at least one of water parameters and outdoor parameters and data in the form of desired pool or spa set points.

According to yet another aspect of the present invention, the method may further include the step of adjusting motor speed to achieve maximum efficiency while reaching and maintaining desired pool or spa set points.

BRIEF DESCRIPTION OF THE DRAWINGS

FIG. 5 is a table used in the control logic of the controller of the of the pool pump assembly of FIG. 3, showing the pool and pool system inputs and outputs.

DETAILED DESCRIPTION OF THE INVENTION

Figure 1:
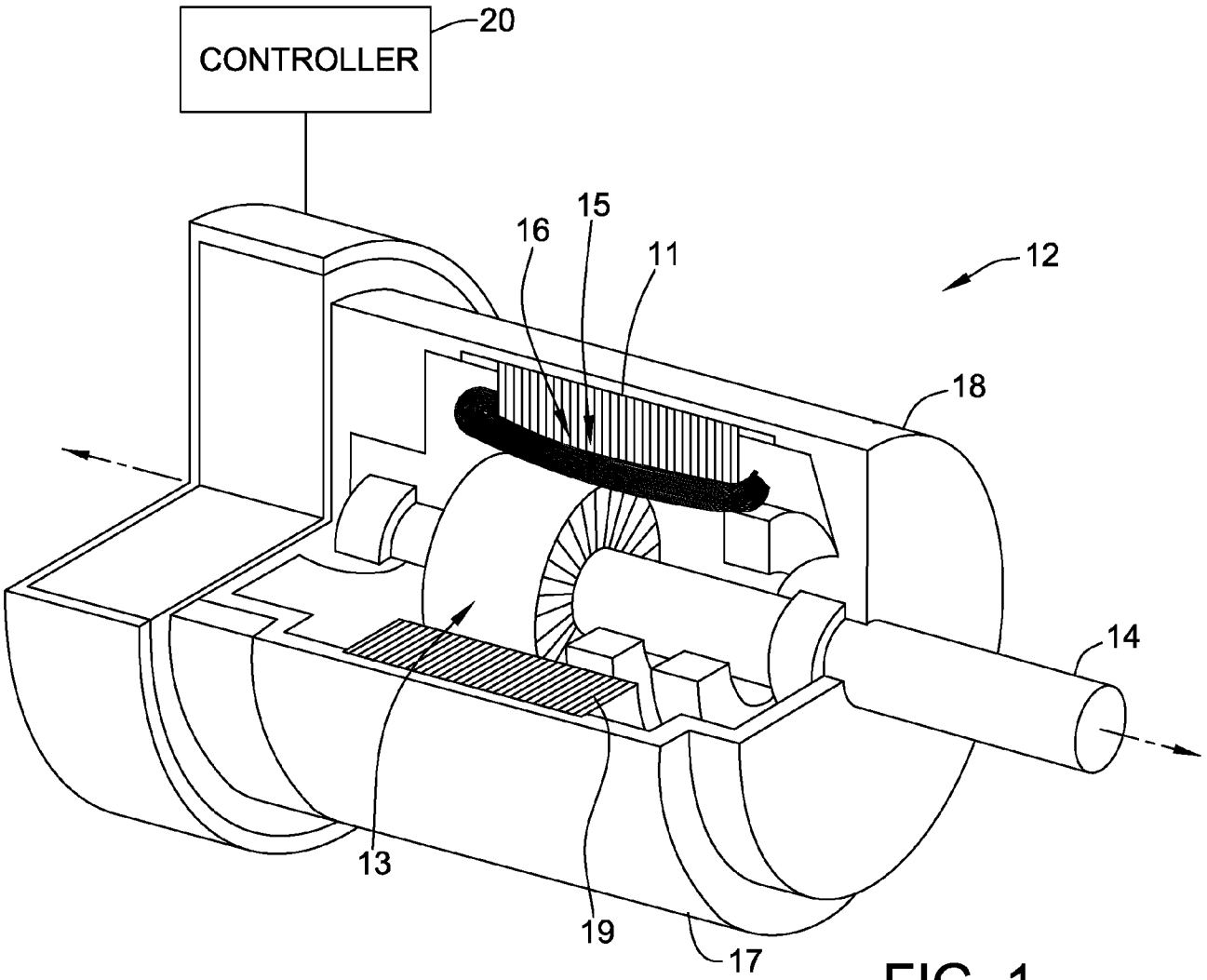
FIG. 1 is a perspective view, partially in cross section, of an embodiment of the present invention in the form of an electric motor assembly.

Pool and spa pumps are used to circulate water within the pool. The circulation of the water disperses chemicals added to the water to provide for acceptable water conditions. The circulation also permits the passage of water through a filter to remove impurities from the water, to aerate the water, and to provide uniform water temperature in the pool. Typically the pump operates for a portion of the week, typically on a schedule. The pump is typically powered by an electrical motor. The motor may be manually operated, wherein the operator manually controls the pump weekly cycle by manually turning the pump motor off and on.

The electrical motor typically includes a housing for containing and supporting a stator which is excited by an electrical source that excites an electromagnetic field in coils in the stator. The coils interact with a rotor rotatably supported in the housing to provide the mechanical rotational energy for the electrical machine.

Many modern electric machines include a control, for controlling the motor. The control may control the speed and direction of the motor by, for example, controlling the electrical energy going to the coils. The control typically includes a plurality of electrical components.

The electric machine typically includes a housing for containing and supporting the stator. While the electrical components may be positioned in a separate control, spaced from the housing of the electric machine, typically, to reduce cost, to reduce space requirements or for other reasons, at least a portion of the electrical components are positioned within the electric machine housing.

More sophisticated pool pump systems have timers for turning the pump off and on based on a schedule. Some even more sophisticated pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

These pool pump systems may not provide for optimum pool conditions either at set up or over time when pool conditions change. These systems require periodic adjustments to the scheduled on and off times and to the motor speeds to obtain optimum efficiency. Such systems may not provide for optimum pool conditions at initial set up and may not provide for optimum pool conditions when adjustments are made to respond to changing pool conditions. Typically such pool pump motor scheduling is made with a trial and error approach.

Improved pool pump motor scheduling is desirable in the design and manufacture of electrical motors and controllers. The method, systems and apparatus described herein facilitate improved pool pump motor scheduling. Designs and methods are provided herein to facilitate improved pool pump motor scheduling.

Technical effects of the methods, systems, and apparatus described herein include at least one of reduced cost, improved serviceability, improved performance and quality and reduced labor costs.

According to an embodiment of the present invention and referring to FIG. 1, an electric machine 12 is provided. The electric machine 12 may be an electric motor or an electric generator, but hereinafter will be described as an electric motor 12. It should be appreciated that the electric motor may be used to power any mechanism, for example, a pump, a cyclic drive, a compressor, a vehicle, a fan or a blower.

The electric motor 12 typically includes a centrally located motor shaft 14 that rotates relative to the motor 12. Electrical energy is applied to coils 15 within the motor 12. The coils 15 generate an electromagnetic field that cooperates with an electromagnetic field in rotor 13 mounted to the motor shaft 14. The coils 15 initiate relative motion between the shaft 14 and the motor 12 that transfers the power from the coils 15 to the shaft 14.

A stationary assembly 16, also referred to as a stator, includes stator core 11 and coils 15 or windings positioned around portions of the stator core. It is these coils to which energy is applied to initiate this relative motion which transfers the power to the shaft. These coils 15 are formed by winding wire (not shown), typically copper, aluminum or a combination thereof, about a central core to form the winding or coil. An electric current is directed through the coils 15 which induces a magnetic field. It is the magnetic field that initiates this relative motion which transfers the power to the shaft 14. The stator core 11 typically includes a plurality of stator core laminations 19 that define stator teeth (not shown) around which the coils 15 are wound.

Typically the motor 12 includes a housing 17 having an inner wall or surface that defines a motor cavity therein. The housing 17 may include a plurality of components and may be made of a suitable durable material, for example a metal, a polymer or a composite. The housing 17 may, as shown, include a cylindrical shell 18 and opposed end caps (not shown).

It should be appreciated that the housing of the motor may have any suitable shape. One common shape of a motor housing is that of a cylindrical solid, having a generally cylindrical cross section. The shaft on a motor with such a shape generally extends from an end of the motor.

The motor 12 may have any suitable size and shape and may be, for example, an induction motor, a permanent-split capacitor (PSC) motor, an electronically commutated motor (ECM) motor, or a switched reluctance motor. The motor 12 may, as shown, be a radial flux motor or may be an axial flux motor. The housing 17 may include protrusions, for example fins (not shown), for dissipation of heat. The motor 12 may also include a fan (not shown) positioned within housing 17. The motor 12 may be electronically controlled, particularly if the motor is an ECM motor, by, for example a motor controller 20. The motor controller 20 may be internally or externally mounted to the motor 12. Alternatively, the controller 20 may be spaced from the motor 12 and may, for example be a part of a system controller (not shown).

Figure 2:
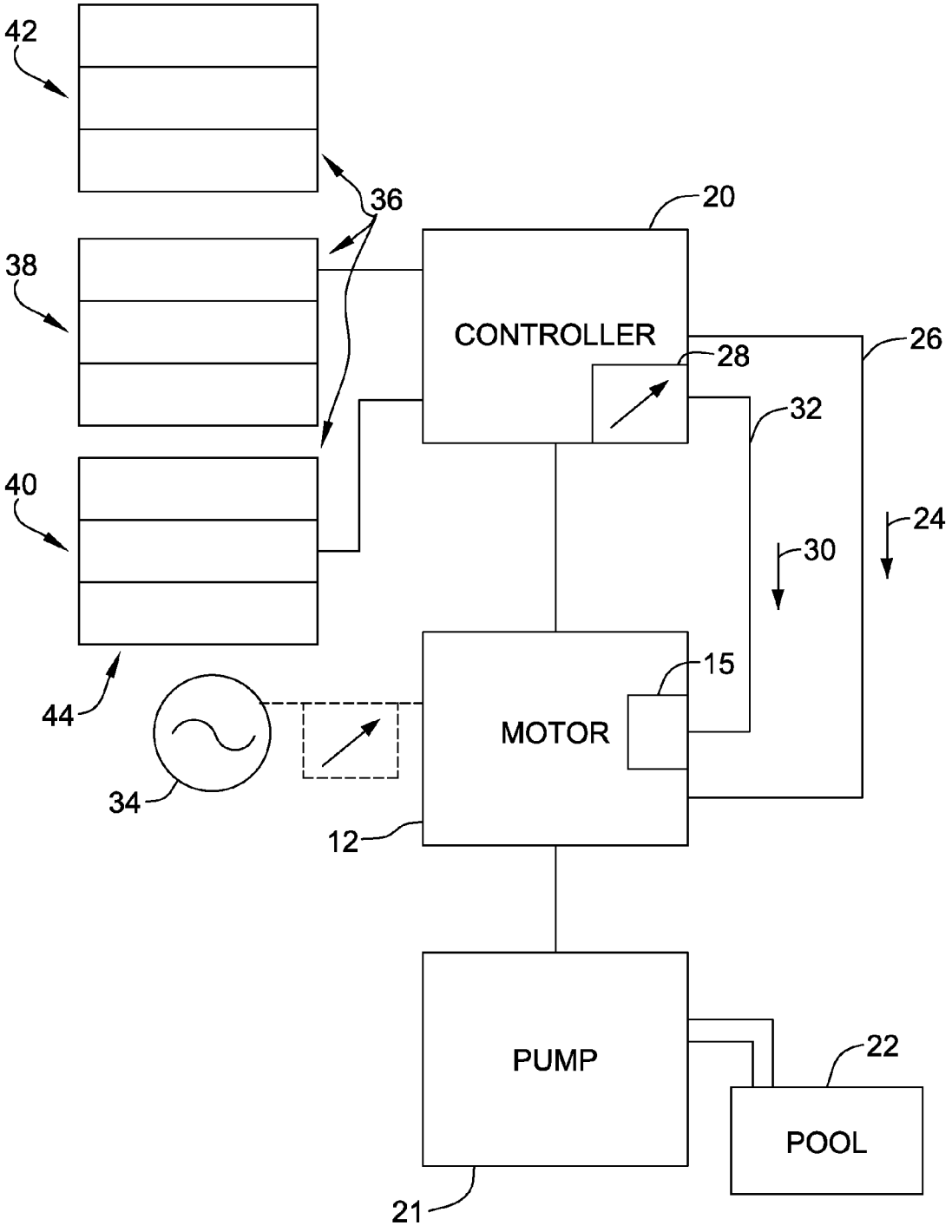
FIG. 2 is a schematic view of another embodiment of the present invention in the form of a motor controller for a motor.
Figure 3:
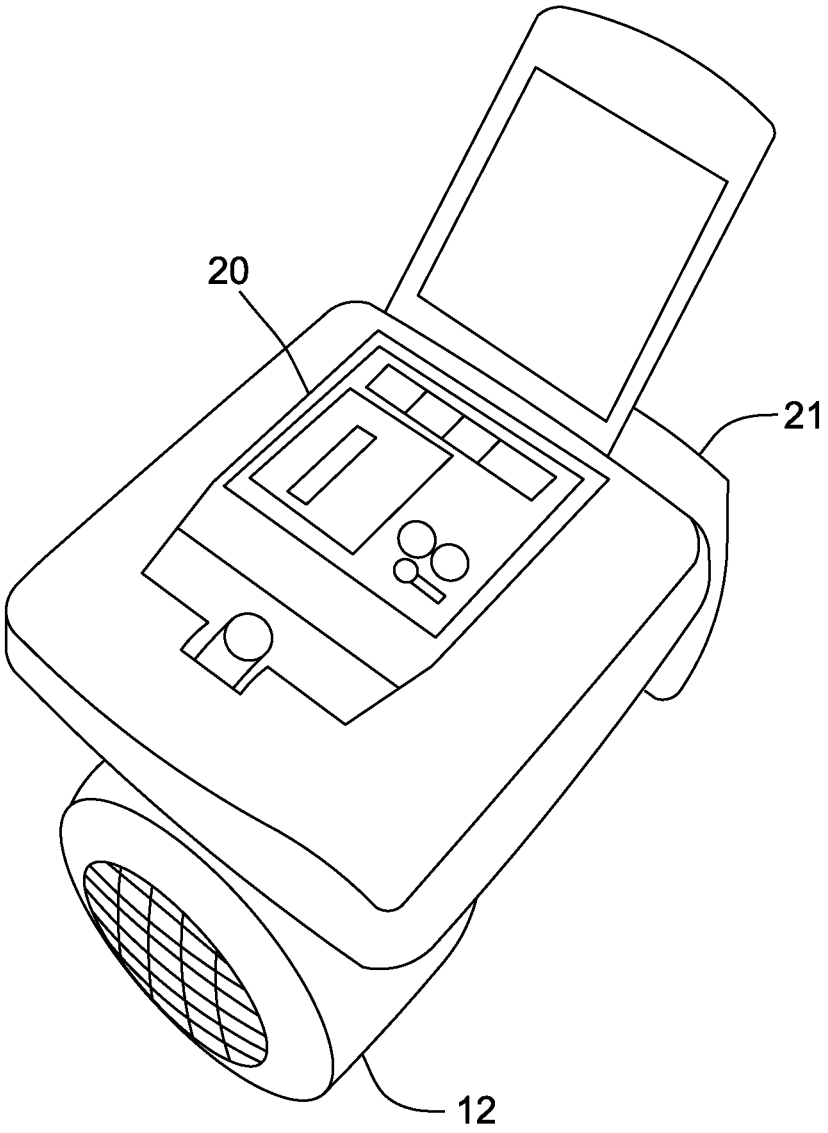
FIG. 3 is a perspective view, partially in cross section, of an embodiment of the present invention in the form of an pool pump assembly.
Figure 4:
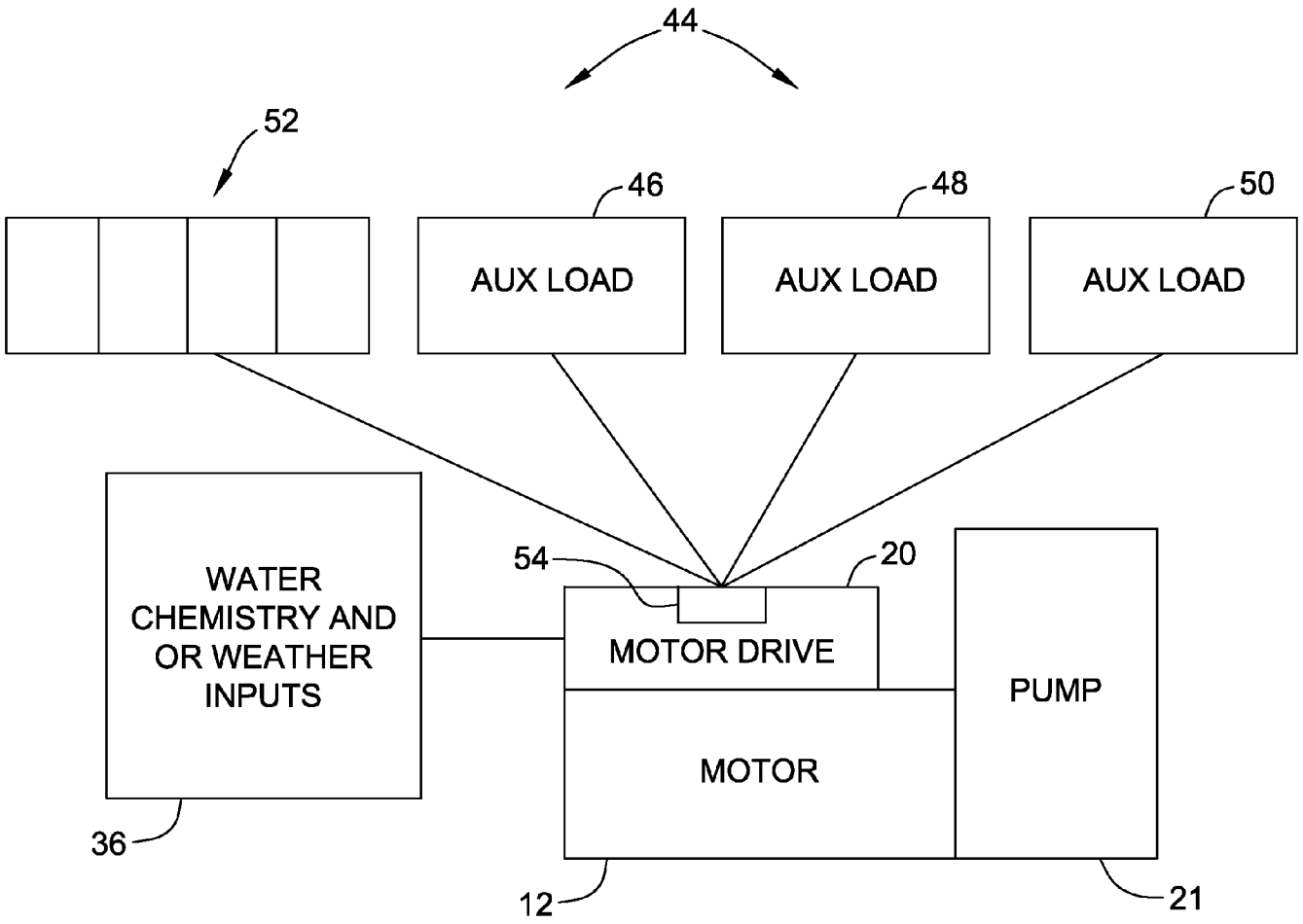
FIG. 4 is a schematic view of the pool pump assembly of FIG. 3.

According to an embodiment of the invention and referring now to FIGS. 2-4, the pump motor controller 20 is provided.

The pump motor controller 20 is utilized to determine speeds and run times of the pump motor 12 for powering a pool pump 21 for use in a pool 22.

For example and as shown in FIG. 4, a speed signal 24 or multiple signals may be sent from the controller 20 to the motor 12 to energize the coils 15 in such a manner to obtain the desired speed. The speed signal 24 may be sent by, for example, a speed signal electrical conduit 26.

The pump motor controller 20 may be any suitable controller capable of controlling the motor and capable of receiving signals to so control the motor 12. The controller 20 may include a circuit board or boards (not shown) that are adapted to receive electronic components (not shown), in the form of, for example, discrete components, integrated circuits or some combination thereof.

The pump motor controller 20 may, for example, include a timer 28 which may be used to determine the run time(s) of the pump motor 12. The timer 28 may be integral with the controller 20 or may be a separate component. The timer 28 and/or the controller 20 may send a run time signal 30 or multiple signals through, for example, a run time electrical conduit 32. Alternatively the timer 28 may be positioned between power source 34 and the controller 20 and the timer 28 may be used to permit power to the controller when the time(s) selected for the pump to operate occur(s). It should be appreciated that, alternately, the run time signal and the speed signal may be combined into a single signal carried in a single conduit.

As shown in FIG. 2, the controller 20 is adapted to receive data 36. The data 36 may be analog or digital. The data 36 may be any data useful in determining pool pump motor speeds and run times for optimum pool water management. For example, the data 36 may be in the form water parameters 38 and outdoor parameters 40 and data in the form of desired pool set points 42, or a combination thereof.

The water parameters 38 may, for example, include total alkalinity, PH, Calcium content, water hardness, free chlorine, bromine, total chlorine, turbidity, water temperature, cyanuric acid, phosphates and total dissolved solids.

The outdoor parameters 40 may, for example, include current weather conditions, upcoming weather events, season, time of day, and geographical location.

The user preferences 42 may, for example, include desired turnovers, motor speed, number of pool users, pool size, and desired operation method. The desired operation method may be an optimization method based on being one of the cleanest method, the lowest cost method, the quietest method and the highest flow method.

Referring again to FIG. 4, the pump motor controller 20 may be adapted to communicate with other devices 44, in the form of, for example, auxiliary loads. For example, the other devices 44 may include pool devices including, for example, a water heater 46, a chlorinator 48 and/or a skimmer 50. The pump motor controller 20 may be further adapted to communicate with other devices 44 in the form of non-pool devices, for example, climate control units and, in particular, climate control motors 52. Such climate control motors 52 may include, air conditioning compressor motors, blower motors, draft inducer motors and evaporator cooling fan motors.

The pump motor controller 20 may be configured to turn the other pool devices 44 off and on based at least in part on one of data 36 in the form of one of water parameters 38 and outdoor parameters 40 and data in the form of user preferences also described as desired pool or spa set points 42.

The other pool devices 44 may be turned off and on in any suitable fashion and may, as described above, be turned on and off based on the water parameters 38 and outdoor parameters 40. For example, the pump controller 20 may include an integrated relay 54 for use in turning off and on the other pool devices 44.

The pump motor controller 20 may be adapted to adjust motor speed of the motor 12 to achieve a maximum efficiency while reaching and maintaining desired pool or spa set points 42.

The controller 20 may be further adapted to receive data 36 in the form of time of day utility rates and peak usage utility rates. The controller may further be adapted to receive data 36 in the form of current time of day. The controller may further be to adapted to determine the speeds and run times of the pump motor 12 for use in the pool 22 based at least in part on data in the form of at least one of current time and utility rates.

While only one of water parameters 38 and outdoor parameters 40 and desired pool or spa set points 42 may be needed to determine the speeds and run times/durations of pump motor 12, more than one of water parameters 38 and outdoor parameters 40 and desired pool or spa set points 42 may be used. For example, water parameters 38 and outdoor parameters 40, water parameters 38 and set points 42, or outdoor parameters 40 and set points 42 may be used. Alternatively, all three of water parameters 38 and outdoor parameters 40 and desired pool or spa set points 42 may be used. Alternatively and/or in addition, the speeds may be dependent on the durations and the durations may be dependent on the speeds.

The determination of the speeds and run times of the pump motor 12 may be performed by the pump motor controller 20 or a similar controller such as a pool system controller. The determination of the speeds and run times may be determined by providing or utilizing code for the controller. The determination of the speeds and run times may be based on formulas and or by the use of tables which provide pump speeds and run times based on inputs to the controller of pool parameters, pump parameters and/or user preferences. Expressed in mathematical terms:

$$\text{Speed } 1 = fn(\text{odp}_n, \text{wap}_m, \text{up}_p, \text{dur}_1)\, n=1, \ldots, N;\ m=1, \ldots, M;\ p=1, \ldots, P$$

$$\text{Speed } 2 = fn(\text{odp}_n, \text{wap}_m, \text{up}_p, \text{dur}_2)\, n=1, \ldots, N;\ m=1, \ldots, M;\ p=1, \ldots, P$$

$$\text{Speed } 3 = fn(\text{odp}_n, \text{wap}_m, \text{up}_p, \text{dur}_3)\, n=1, \ldots, N;\ m=1, \ldots, M;\ p=1, \ldots, P$$

$$\text{Duration } 1 = fn(\text{odp}_n, \text{wap}_m, \text{up}_p, \text{spe}_1)\, n=1, \ldots, N;\ m=1, \ldots, M;\ p=1, \ldots, P$$

$$\text{Duration } 2 = fn(\text{odp}_n, \text{wap}_m, \text{up}_p, \text{spe}_2)\, n=1, \ldots, N;\ m=1, \ldots, M;\ p=1, \ldots, P$$

$$\text{Duration } 3 = fn(\text{odp}_n, \text{wap}_m, \text{up}_p, \text{spe}_3)\, n=1, \ldots, N;\ m=1, \ldots, M;\ p=1, \ldots, P$$

Where: odp=outdoor parameters
wap=water parameters
pup=user preferences
dur=duration
spe=speed
fn=function
n=number of that variable These above equations can be determined based on empirical data obtained by varying one or more variables and plotting the results.

Note that the equation above assumes that the function is only dependent on the corresponding speed or duration. Alternatively, the equation may be dependent on additional speeds and durations.

Referring now to FIG. 5, a table of inputs (outdoor parameters [month of year=$\text{odp}_1$, raining-$\text{odp}_2$,] water parameters [chlorine level=$\text{wap}_1$, PH=$\text{wap}_2$, Alkalinity=$\text{wap}_3$] and user preferences [pool size=$\text{pup}_1$, optimization method=$\text{pup}_2$]) and outputs (speeds and run times) is shown. Note that each output, (Speed 1, Duration 1, Speed 2, Duration 2, Speed 3, and Duration 3), may only vary on some of the input and be unaffected by some other inputs. Note that one or more of the outputs may be zero.

For example and again referring to FIG. 5, Duration 1 may be a function of Pool size, Month of year, Raining, PH and Alkalinity.

Figure 6:
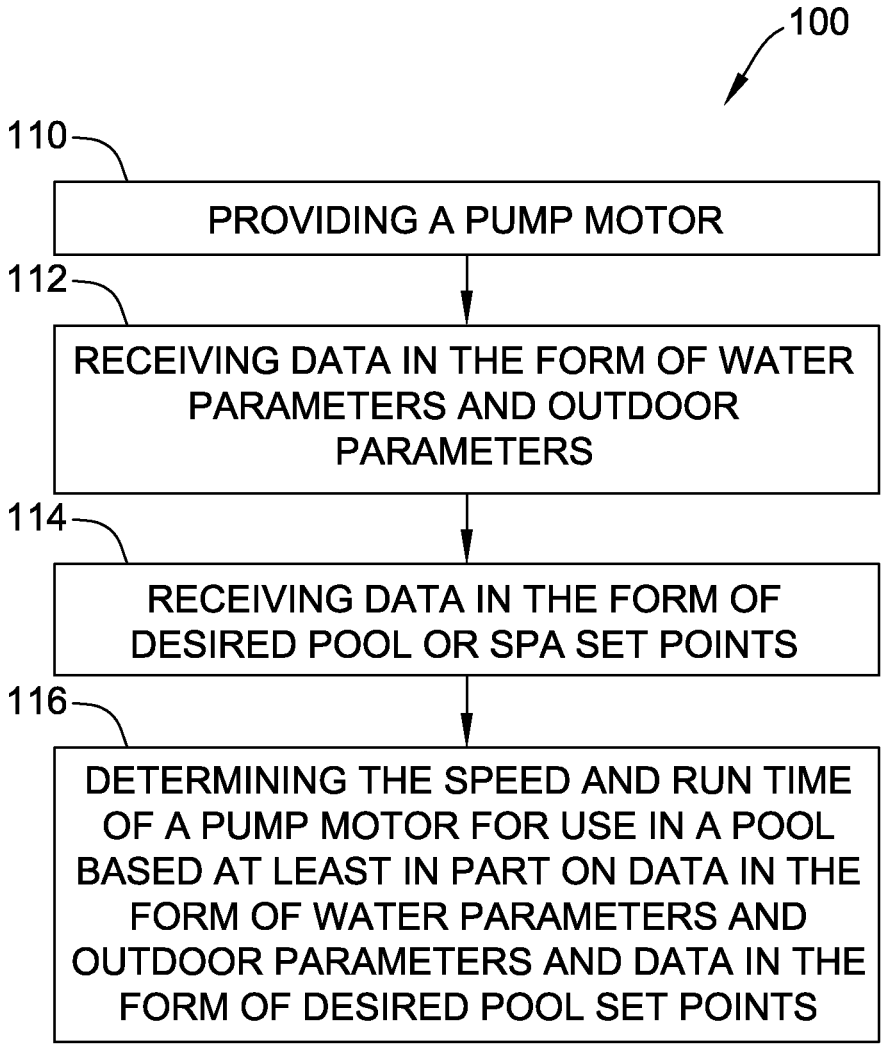
FIG. 6 is a flow chart of another embodiment of the present invention in the form of a method for providing controlling a motor.

Referring now to FIG. 6, a method 100 for determining the speeds and run times of a pump motor for use in a pool is provided. The method 100 includes step 110 of providing a pump motor, step 112 of of receiving data in the form of water parameters and outdoor parameters, step 114 of receiving data in the form of desired pool or spa set points, and step 116 of determining the speeds and run times of the pump motor for use in a pool based at least in part on data in the form of at least one of water parameters and outdoor parameters and data in the form of desired pool set points.

The method 100 may further include the step of communicating with other pool devices to turn them off and on based at least in part on data in the form of at least one of water parameters and outdoor parameters and data in the form of desired pool or spa set points.

The method 100 may further include the step of turning off and on integrated relay for auxiliary loads for other pool or spa devices to turn them off and on based at least in part on data in the form of at least one of water parameters and outdoor parameters and data in the form of desired pool or spa set points.

The method 100 may further include the step of adjusting motor speed to achieve maximum efficiency while reaching and maintaining desired pool or spa set points.

The methods, systems, and apparatus described herein facilitate efficient and economical assembly of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing an improved method and motor controller that reduces or eliminates the efficiency loss caused by a less optimum operation of the pump motor. Furthermore, the exemplary methods system and apparatus achieve increased efficiency while reducing effort in optimizing the operation of the pump motor. The methods, system and apparatus described herein may be used in any suitable application. However, they are particularly suited for pump applications.

Exemplary embodiments of the pool pump motor and controller are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The methods, systems, and apparatus described herein facilitate pool pump motor scheduling of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing improved pool pump motor scheduling. Furthermore, the exemplary methods system and apparatus achieve improved pool pump motor scheduling. The methods, system and apparatus described herein may be used in any suitable application. However, they are particularly suited for pump applications.

Exemplary embodiments of the fluid flow device and system are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pump motor controller for determining the speeds and run times of a pump motor for: use in a pool or a spa, the pump motor having at least a high speed and a low speed:

wherein said controller receives at least one of water parameters data and outdoor parameters data;

wherein said controller receives desired pool or spa set points;

wherein said controller determines the speeds and run times of a pump motor for use in a pool based at least in part on at least one of water parameters data and outdoor parameters data and pool or spa set points;

wherein the pump motor controller receives data corresponding to one of a plurality of operation methods, one of the plurality of operation methods optimized for low cost with the motor operating at the high speed for a specified time period and another of the plurality of operation methods optimized for quiet operation with the motor operating at the low speed for a longer time period than the specified time period and wherein said controller determines the speeds and run times of a pump motor for use in a pool based at least in part on the one of said plurality of operation methods; and wherein the pump motor controller thereby controls the operation of the pump motor.

2. The pump motor controller according to claim 1, wherein said controller is adapted to communicate with other pool devices to turn them off and on based at least in part on data in the form of at least one of water parameters and outdoor parameters and data in the form of desired pool or spa set points.

3. The pump motor controller according to claim 1:

further comprising an integrated relay; and wherein said controller turns off and on said integrated relay for auxiliary loads for other pool or spa devices to turn them off and on based at least in part on data in the form of at least one of water parameters and outdoor parameters and data in the form of desired pool or spa set points.

4. The pump motor controller according to claim 1, wherein said controller adjusts motor speed to achieve maximum energy efficiency while reaching and maintaining desired pool or spa set points.

5. The pump motor controller according to claim 1:

wherein said controller receives not peak time of day usage utility rates and peak time of day usage utility rates;

wherein said controller receives current time of day data; and wherein said controller determines the speeds and run times of a pump motor for use in a pool or spa based at least in part on current time of day data and not peak time of day usage utility rates and peak time of day usage utility rates.

6. The pump motor controller according to claim 1, wherein data in the form of at least one of water parameters and outdoor parameters comprises at least one of current weather conditions, upcoming weather events, season, time of day and geographical location.

7. The pump motor controller according to claim 1, wherein data in the form of at least one of water parameters and outdoor parameters comprises at least one of total alkalinity, PH, Calcium content, water hardness, free chlorine, bromine, total chlorine, turbidity, water temperature, cyanuric acid, phosphates, and total dissolved solids.

8. The pump motor controller according to claim 1, wherein data in the form of desired water parameters and outdoor parameters comprises at least two of current weather conditions, upcoming weather events, season, time of day, geographical location, total alkalinity, PH, Calcium content, water hardness, free chlorine, bromine, total chlorine, turbidity, water temperature, cyanuric acid, phosphates, and total dissolved solids.

9. The pump motor controller according to claim 1, wherein data in the form of desired pool or spa set points comprises at least one of turns, motor speed, number of pool users and pool size.

10. An electric motor assembly for use to power a pump in a pool or a spa, comprising: a motor adapted to be connected to the pump, the motor having at least a high speed and a low speed; and a pump motor controller for controlling said motor, wherein said controller receives at least one of water parameters data and outdoor parameters data, wherein said controller receives desired pool or spa set points, and wherein said controller determines the speeds and run times of a pump motor for use in a pool based at least in part on at least one of water parameters data and outdoor parameters data and pool or spa set points, wherein the pump motor controller receives data corresponding to one of a plurality of operation methods and wherein said controller determines the speeds and run times of a pump motor for use in a pool based at least in part on the one of said plurality of operation methods, one of the plurality of operation methods optimized for low cost with the motor operating at the high speed for a specified time period and another of the plurality of operation methods optimized for quiet operation with the motor operating at the low speed for a longer time period than the specified time period.

11. The electric motor assembly according to claim 10, wherein said controller is adapted to communicate with other pool devices to turn them off and on based at least in part on data in the form of at least one of water parameters and outdoor parameters and data in the form of desired pool or spa set points.

12. The electric motor assembly according to claim 10:

further comprising an integrated relay; and wherein said controller turns off and on said integrated relay for auxiliary loads for other pool or spa devices to turn them off and on based at least in part on one of data in the form of water parameters and outdoor parameters and data in the form of said desired pool or spa set points.

13. The electric motor assembly according to claim 10, wherein said controller adjusts motor speed to achieve maximum energy efficiency while reaching and maintaining said desired pool or spa set points.

14. The electric motor assembly according to claim 10:

wherein said controller receives not peak time of day usage utility rates and peak time of day usage utility rates;

wherein said controller receives current time of day data; and wherein said controller determines the speeds and run times of a pump motor for use in a pool or spa based at least in part on current time of day data and not peak time of day usage utility rates and peak time of day usage utility rates.

15. The electric motor assembly according to claim 10, wherein data in the form of water parameters and outdoor parameters comprises at least one of current weather conditions, upcoming weather events, season, time of day and geographical location.

16. The electric motor assembly according to claim 10, wherein data in the form of water parameters and outdoor parameters comprises at least one of total alkalinity, PH, Calcium content, water hardness, free chlorine, bromine, total chlorine, turbidity, water temperature, cyanuric acid, phosphates, and total dissolved solids.

17. A method for determining the speeds and run times of a pump motor for use in a pool or a spa, comprising:

providing a pump motor, the motor having at least a high speed and a low speed;

receiving water parameters data and outdoor parameters data;

receiving data corresponding to one of a plurality of operation methods;

determining the speeds and run times of a pump motor for use in a pool based at least in part on the one of said plurality of operation methods utilizing one of a table and a formula to determine such speeds and run times, one of the plurality of operation methods optimized for low cost and another of the plurality of operation methods optimized for quiet operation; and controlling the operation of the pump motor based on the one of a plurality of operation methods, the one of the plurality of operation methods optimized for low cost having the motor operating at the high speed for a specified time period and the other of the plurality of operation methods optimized for quiet operation with the motor operating at the low speed for a longer time period than the specified time period.

18. The method according to claim 17, further comprising communicating with other pool devices to turn them off and on based at least in part on data in the form of at least one of water parameters and outdoor parameters and data in the form of desired pool or spa set points.

19. The method according to claim 17, further comprising turning off and on an integrated relay for auxiliary loads for other pool or spa devices to turn them off and on based at least in part on data in the form of at least one of water parameters and outdoor parameters and data in the form of desired pool or spa set points.

20. The method according to claim 17, further comprising adjusting motor speed to achieve maximum energy efficiency while reaching and maintaining desired pool or spa set points.

* * * * *